US006935319B2

(12) United States Patent
Aupperle et al.

(10) Patent No.: US 6,935,319 B2
(45) Date of Patent: Aug. 30, 2005

(54) EXHAUST-GAS RECIRCULATION SYSTEM OF AN INTERNAL COMBUSTION ENGINE

(75) Inventors: Walter Aupperle, Korb (DE); Peter Kalisch, Aichtal-Grötzingen (DE)

(73) Assignee: DaimlerChrysler AG, Stuttgart (DE)

( * ) Notice: Subject to any disclaimer, the term of this patent is extended or adjusted under 35 U.S.C. 154(b) by 18 days.

(21) Appl. No.: 10/622,012

(22) Filed: Jul. 17, 2003

(65) Prior Publication Data

US 2004/0050374 A1 Mar. 18, 2004

(30) Foreign Application Priority Data

Jul. 18, 2002 (DE) ..... 102 32 515

(51) Int. Cl.[7] ..... F02B 47/08
(52) U.S. Cl. ..... 123/568.12; 60/605.2
(58) Field of Search ..... 123/568.11, 568.12, 123/568.21, 563; 60/599, 605.2

(56) References Cited

U.S. PATENT DOCUMENTS 3,074,390 A * 1/1963 O'Laughlin ..... 123/568.12
5,666,932 A * 9/1997 Bauerle et al. ..... 123/568.21
6,053,154 A * 4/2000 Pott ..... 123/568.12
6,138,649 A * 10/2000 Khair et al. ..... 123/568.12
6,244,256 B1 * 6/2001 Wall et al. ..... 123/568.12
2003/0178002 A1 * 9/2003 Israel et al. ..... 123/321

FOREIGN PATENT DOCUMENTS

| | | |
|---|---|---|
| DE | 44 14 429 | 6/1995 |
| EP | 0 596 855 | 5/1994 |
| EP | 1 091 113 | 4/2001 |
| WO | WO 99/09307 | 2/1999 |

* cited by examiner

*Primary Examiner*—Willis R. Wolfe, Jr.
(74) *Attorney, Agent, or Firm*—Klaus J. Bach

(57) ABSTRACT

In an exhaust-gas recirculation system of an internal combustion engine with an exhaust-gas recirculation line extending between an exhaust duct and an inlet duct, wherein the exhaust-gas recirculation line includes an exhaust-gas recirculation valve and also at least one first exhaust-gas cooler, at least one second exhaust-gas cooler is provided in the exhaust gas recirculation line and the exhaust-gas recirculation valve is arranged between the first exhaust-gas cooler and the second exhaust-gas cooler so that only the first exhaust gas cooler is subjected to the high exhaust gas pressure effective during engine braking when the exhaust gas recirculation valve is closed.

8 Claims, 1 Drawing Sheet

EXHAUST-GAS RECIRCULATION SYSTEM OF AN INTERNAL COMBUSTION ENGINE

BACKGROUND OF THE INVENTION

The invention relates to an exhaust-gas recirculation system for motor vehicles, with an exhaust-gas recirculation line extending between an exhaust-gas duct and an inlet duct and including an exhaust-gas recirculation valve and at least one exhaust-gas cooler.

An exhaust-gas recirculation system for motor vehicles is already known from EP 0 596 855 A1. The exhaust-gas recirculation line, in this case, has an exhaust-gas recirculation valve and an exhaust-gas heat exchanger arranged downstream of the exhaust-gas recirculation valve with respect to the direction of flow. Moreover, an exhaust-gas purification device is arranged between the exhaust-gas recirculation valve and the exhaust-gas heat exchanger.

It is the object of the present invention to provide an exhaust-gas recirculation system, which achieves optimum cooling of the exhaust gases and high durability of the system at relatively low costs.

SUMMARY OF THE INVENTION

In an exhaust-gas recirculation system of an internal combustion engine with an exhaust-gas recirculation line extending between an exhaust duct and an inlet duct, wherein the exhaust-gas recirculation line includes an exhaust-gas recirculation valve and also at least one first exhaust-gas cooler, at least one second exhaust-gas cooler is provided in the exhaust gas recirculation line and the exhaust-gas recirculation valve is arranged between the first exhaust-gas cooler and the second exhaust-gas cooler so that only the first exhaust gas cooler is subjected to the high exhaust gas pressure effective during engine braking when the exhaust gas recirculation valve is closed.

As a result, in motor vehicles with an engine-braking mode or with an exhaust-gas conduction system that can be blocked, the second exhaust-gas cooler is not subjected to high exhaust-gas pressures when the exhaust-gas recirculation valve is closed. The first exhaust-gas cooler, which is arranged upstream of the exhaust-gas recirculation valve with respect to the direction of flow, prevents an overheating and excessive corrosion of the exhaust-gas recirculation valve. The exhaust-gas recirculation valve can thus be arranged within the exhaust-gas recirculation line optimally within the available construction-space conditions and the existing temperature conditions. The exhaust-gas cooling additionally necessary for optimum combustion is achieved by means of the second exhaust-gas cooler, which is arranged downstream of the exhaust-gas recirculation valve and is not exposed to high temperatures and high pressures.

For this purpose, the first exhaust-gas cooler is designed as a pressure- and temperature-resistant cooler. This ensures that the load peaks during the engine-braking mode do not result in damage to the first exhaust-gas cooler. The greater wall thickness necessary in this case however leads to a lower cooling capacity of the first exhaust-gas cooler.

The second exhaust-gas cooler is designed as a low-pressure cooler, which requires walls of only a relatively small thickness. This results, according to the smaller wall thickness with the same construction size, in an improved cooling capacity of the second exhaust-gas cooler and lower exhaust gas temperatures and consequently, overall, in an optimized combustion process.

It is also advantageous, in this regard, if at least one further exhaust-gas cooler is provided upstream of the exhaust-gas recirculation valve with respect to the direction of flow. According to the available space conditions, the necessary cooling capacity between the exhaust-gas manifold and the exhaust-gas recirculation valve can be ensured by means of a plurality of small coolers rather than one relatively large cooler.

It is advantageous for the present invention if the inlet and the outlet the exhaust-gas recirculation valve are arranged on a common lateral surface of the exhaust-gas recirculation valve. The exhaust-gas recirculation line may then extend from the first exhaust gas cooler to one side of the exhaust-gas recirculation valve and extend from the same side of the exhaust-gas recirculation valve back to the second exhaust gas cooler. This results in a deflection of the exhaust-gas recirculation line, which is suitable for the available design-space conditions.

It is also advantageous if the charge-air cooler, the first exhaust-gas cooler and/or the second exhaust-gas cooler have a common cooling circuit. The temperature level of the coolers can thereby be taken into account: The coolant, after passing through the charge-air cooler, can still be utilized for cooling the first exhaust-gas cooler on the hot side of the exhaust-gas recirculation valve, since the existing temperature difference ensures sufficient cooling capacity.

Further advantages and details of the invention will be explained in the description on the basis of the accompanying drawings:

DESCRIPTION OF A PREFERRED EMBODIMENT

Figure 1:
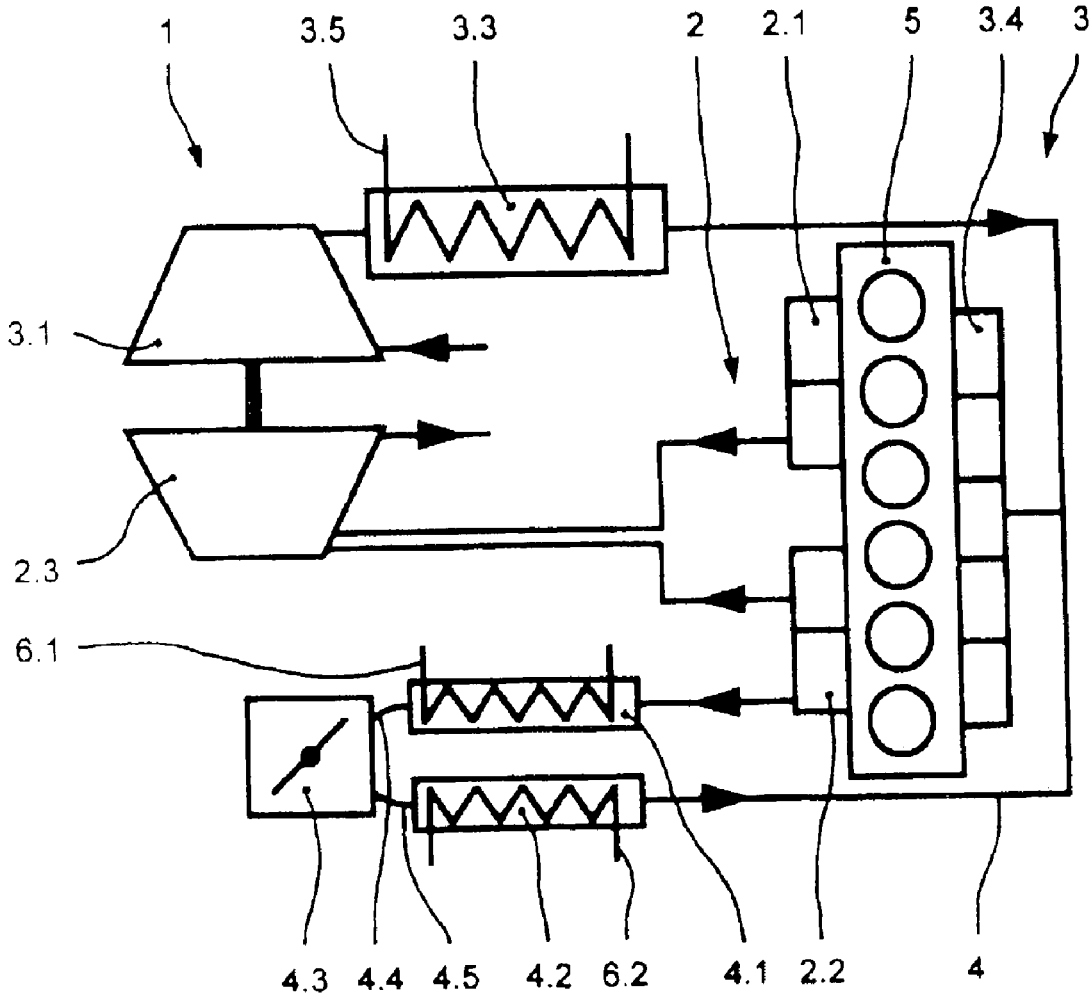
FIG. 1 shows diagrammatically an internal combustion engine with an inlet system, an exhaust-gas discharge system and an exhaust-gas recirculation system.

FIG. 1 illustrates an internal combustion engine, an air inlet system 3 and an exhaust-gas discharge system 2, of the internal combustion engine, which includes a cylinder block 5. The exhaust-gas discharge system 2 is connected to the cylinder block 5 via a first exhaust-gas manifold 2.1 and a second exhaust-gas manifold 2.2. The exhaust-gas discharge system 2 extends from the first exhaust-gas manifold 2.1 or from the second exhaust-gas manifold 2.2 to an exhaust-gas turbine 2.3.

The exhaust-gas turbine 2.3 serves as a motor for a charge-air compressor 3.1, via which charge air is supplied to the air inlet system 3. The air inlet system 3 includes a charge-air cooler 3.3 which, in turn, is connected to a charge-air manifold 3.4 on the cylinder block 5.

Connected to the second exhaust-gas manifold 2.2, is an exhaust-gas recirculation line 4, which is connected at its other end, together with the air inlet system 3, to the charge-air manifold 3.4. The exhaust-gas recirculation line 4 includes a first exhaust-gas cooler 4.1 which, in turn, is connected to an exhaust-gas recirculation valve 4.3. Provided downstream of the exhaust-gas recirculation valve 4.3 with respect to the direction of flow is a second exhaust-gas cooler 4.2 which is in communication with the charge-air manifold 3.4.

The first exhaust-gas cooler 4.1 is designed as a high-pressure cooler which, in the engine braking mode and with the exhaust-gas recirculation valve 4.3 closed, is subjected to the pressure pulses within the exhaust-gas discharge system 2. The second exhaust-gas cooler 4.2 is designed as a low-pressure cooler which, with the exhaust-gas recirculation valve 4.3 closed, is exposed to markedly lower pressure pulses. It has walls of a relatively small wall thickness, thereby providing for an optimum heat transfer and therefore a relatively low exhaust-gas temperature.

Both, the charge-air cooler 3.3 and the first exhaust-gas cooler 4.1 or the second exhaust-gas cooler 4.2 may be designed as gas or liquid cooled coolers. The charge-air cooler 3.3 is provided with a cooling circuit 3.5, the first exhaust-gas cooler 4.1 is provided with a cooling circuit 6.1 and the second exhaust-gas cooler 4.2 is provided with a cooling circuit 6.2, the cooling circuit 6.1 and the cooling circuit 6.2 being operatively connected in a way not illustrated, for example, to the engine cooling circuit.

What is claimed is:

1. An exhaust gas recirculation system (2) for a motor vehicle, including an exhaust gas recirculation line (4) extending between an exhaust gas manifold (22) and an air inlet system (3) of said internal combustion engine, said exhaust gas recirculation line (4) including an exhaust gas recirculation valve (4.3), at least one first exhaust gas heat exchanger (4.1) arranged upstream of said recirculation valve (4.3) and at least one second exhaust gas heat exchanger (4.2) provided in the exhaust gas recirculation line (4) downstream of the exhaust gas recirculation valve with respect to the direction of flow of the exhaust gas through said exhaust gas recirculation line (4) for cooling the exhaust gas.

2. A system according to claim 1, wherein the first exhaust-gas heat exchanger (4.1) is designed as a pressure-resistant cooler.

3. A system according to claim 1, wherein the second exhaust-gas heat exchanger (4.2) is designed as a low-pressure cooler.

4. A system according to claim 1, wherein at least one further high-pressure exhaust-gas heat exchanger for cooling the exhaust gas is provided upstream of the exhaust-gas recirculation valve (4.3) with respect to the direction of flow.

5. A system according to claim 1, wherein at least one further low-pressure exhaust-gas heat exchanger for cooling the exhaust gas is provided downstream of the exhaust-gas recirculation valve (4.3) with respect to the direction of flow.

6. A system according to claim 1, wherein the exhaust-gas recirculation valve (4.3) has an inlet (4.4) and an outlet (4.5), the inlet (4.4) and the outlet (4.5) being arranged on a common lateral surface of the exhaust-gas recirculation valve (4.3).

7. A system according to claim 1, wherein a charge-air cooler (3.3), and at least one of the first exhaust-gas heat exchanger (4.1) and the second exhaust-gas heat exchanger (4.2) have a common cooling circuit (3.5).

8. A system according to claim 1, wherein a charge-air cooler (3.3), the first exhaust-gas heat exchanger (4.1) and the second exhaust-gas heat exchanger (4.2) have separate cooling circuits.

* * * * *